US008800191B2

(12) United States Patent
Williams et al.

(10) Patent No.: US 8,800,191 B2
(45) Date of Patent: Aug. 12, 2014

(54) COMPACT FIREARM BARREL CLEANING BRUSH

(75) Inventors: Lawrence Williams, Turin, NY (US); Kel Shipman, Rochester, NY (US)

(73) Assignee: The Otis Patent Trust, Lyons Falls, NY (US)

( * ) Notice: Subject to any disclaimer, the term of this patent is extended or adjusted under 35 U.S.C. 154(b) by 199 days.

(21) Appl. No.: 13/351,381

(22) Filed: Jan. 17, 2012

(65) Prior Publication Data

US 2012/0186128 A1 Jul. 26, 2012

Related U.S. Application Data

(63) Continuation-in-part of application No. 12/551,763, filed on Sep. 1, 2009, now Pat. No. 8,186,092.

(60) Provisional application No. 61/488,539, filed on May 20, 2011.

(51) Int. Cl.
*F41A 29/02* (2006.01)

(52) U.S. Cl.
CPC ..... *F41A 29/02* (2013.01)
USPC ..... 42/95; 15/104.2

(58) Field of Classification Search
CPC ..... F41A 29/00; F41A 29/02; F41A 29/04
USPC ..... 42/95; 15/104.16, 104.165, 104.17, 15/104.18, 104.19, 104.2
See application file for complete search history.

(56) References Cited

U.S. PATENT DOCUMENTS

| | | | | |
|---|---|---|---|---|
| 190,123 | A | | 5/1877 | Budd |
| 358,304 | A | | 2/1887 | Simpson |
| 1,495,008 | A | * | 5/1924 | Feagin ..... 102/442 |
| 2,379,962 | A | * | 7/1945 | Hoerle ..... 15/104.2 |
| 2,420,044 | A | | 5/1947 | Jowett |
| 2,559,376 | A | * | 7/1951 | Schnitger ..... 15/104.05 |
| 4,144,609 | A | | 3/1979 | Dubs |
| 4,399,627 | A | | 8/1983 | Malesky et al. |
| 4,547,924 | A | | 10/1985 | Brygider |
| 4,716,673 | A | | 1/1988 | Williams et al. |
| 4,873,778 | A | * | 10/1989 | Stipp ..... 42/95 |
| 4,901,465 | A | | 2/1990 | Hsu |
| 4,962,607 | A | | 10/1990 | Baldwin |

(Continued)

OTHER PUBLICATIONS

The International Bureau of WIPO, International Report on Patentablity for PCT/US2010/047303 dated Mar. 6, 2012 (9 pgs).

*Primary Examiner* — Stephen M Johnson
(74) *Attorney, Agent, or Firm* — Harris Beach PLLC

(57) ABSTRACT

A firearm barrel cleaning brush includes a body, a first swab portion affixed to the body, a bristle brush portion affixed to the body, and a second swab portion affixed to the body. The bristle brush portion is proximate to the first swab portion, and is positioned closer to an end of the body than the first swab portion. The second swab portion is proximate to the bristle brush portion, and is positioned closer to the end of the body than the bristle brush portion. In one embodiment, the cleaning brush is secured to a flexible cleaning rod having a pull-through handle having a base, a swivel, and a handle portion attached to the base by the swivel. The handle portion has a closed position adapted for passage through the firearm barrel, and an open position adapted for pulling the cleaning rod and barrel cleaning brush through the firearm barrel.

14 Claims, 7 Drawing Sheets

(56) References Cited

U.S. PATENT DOCUMENTS

| | | | | | |
|---|---|---|---|---|---|
| 5,038,509 | A | | 8/1991 | Stephan | |
| 5,233,124 | A | * | 8/1993 | Peterson | 86/1.1 |
| 5,317,827 | A | | 6/1994 | Jaremco | |
| 5,337,505 | A | | 8/1994 | Brown et al. | |
| 5,357,705 | A | | 10/1994 | Stengel | |
| 5,447,572 | A | | 9/1995 | LaClair | |
| 5,557,871 | A | | 9/1996 | LaLonde | |
| 5,715,559 | A | * | 2/1998 | Mitri | 15/118 |
| 5,871,589 | A | | 2/1999 | Hedge | |
| 6,269,579 | B1 | | 8/2001 | Warner | |
| 6,630,034 | B1 | | 10/2003 | Schnell | |
| 6,701,658 | B1 | | 3/2004 | Brownell | |
| 6,758,005 | B2 | | 7/2004 | Teper | |
| 7,165,673 | B2 | | 1/2007 | Marks | |
| 7,356,961 | B2 | | 4/2008 | Williams | |
| 7,441,363 | B1 | | 10/2008 | Black et al. | |
| 2006/0236584 | A1 | | 10/2006 | Williams | |
| 2007/0294930 | A1 | | 12/2007 | Mays | |
| 2011/0168207 | A1 | | 7/2011 | Smith | |

* cited by examiner

COMPACT FIREARM BARREL CLEANING BRUSH

CROSS REFERENCE TO RELATED APPLICATIONS

This is a continuation-in-part of the invention described in U.S. patent application Ser. No. 12/551,763, filed Sep. 1, 2009 by the same inventors herein, titled "INTEGRATED DUAL TECHNOLOGY BRUSH." now U.S. Pat. No. 8,186,092 The invention described in U.S. patent application Ser. No. 12/551,763 is assigned to the assignee hereof. Reference is made to and this application claims priority from and the benefit of U.S. Provisional Application Ser. No. 61/488,539, filed May 20, 2011, entitled "BOLT AND BOLT CARRIER CLEANING SYSTEM AND TOOLS WITH INTEGRATED PULL-THROUGH HANDLE", which application is incorporated herein by reference.

FIELD OF THE INVENTION

This invention relates generally to the field of barrel cleaning brushes for firearms.

BACKGROUND OF THE INVENTION

With each use, the breech and bore of a firearm accumulate fouling and debris. Most fouling and debris originates from the firearm itself, such as propellant residue (i.e., carbon deposits), priming compound, and ammunition casings (i.e., copper fragments). But fouling and debris may also originate from the environment if the firearm is used outdoors, such as: dirt, sand, mud, moisture, and plant matter. The presence of such materials can moderately to severely compromise the efficacy of a firearm absent proper periodic cleaning of its barrel. For example, the short term build-up of materials within a firearm barrel can undesirably delay the release time of a bullet or other form of ammunition fired from the firearm. Also, materials that remain within a firearm's barrel for a prolonged period of time can cause corrosion or other significant degradation of the firearm's components, thus potentially necessitating expensive repair or replacement of the firearm. Failure to remove the residue and debris may even pose a safety hazard to the operator. Therefore, proper cleaning is one of the most important elements of firearm ownership.

Although the design of firearm cleaning devices has varied over time, they tend to fall into one of two general design categories: rigid devices and flexible devices. Despite differences in their design, firearm barrel cleaning devices are generally used in similar ways, namely by being inserted within the firearm to loosen or dislodge (e.g., by one or more of brushing, scraping and/or rinsing actions) unwanted materials from within the barrel. The dislodged materials are then removed from the barrel through the use of one or more additional devices.

Because the breeches of firearms typically contain numerous intricate components, a variety of cleaning tools may be needed to thoroughly clean the firearm. A tool cleaning kit may contain brushes, a punch pin, a scraper, and a pick, to name a few. Firearm owners may purchase kits containing the required tools to thoroughly clean a particular model of firearm. Although the kits can be useful and may be advantageous for certain applications, the cleaning process can be time-consuming. Military personnel need to be able to clean their weapons in the field, preferably immediately after shooting so that their firearm is ready for use at all times. Therefore, there is a need to decrease the time and steps required to thoroughly clean a firearm.

SUMMARY OF THE INVENTION

In one aspect of the invention, a firearm barrel cleaning brush includes a body defining a first end and an opposing second end, the first end including a connector portion. The firearm barrel cleaning brush further includes a first swab portion affixed to the body. The first swab portion extends radially from the body and has a first outer diameter D1 that is greater than an inner diameter of the firearm barrel to be cleaned. The firearm barrel cleaning brush further includes a bristle brush portion affixed to the body, proximate to the first swab portion and positioned closer to the second end of the body than the first swab portion. A second swab portion affixed to the body extends radially therefrom. The second swab portion is proximate to the bristle brush portion, and is positioned closer to the second end of the body than the bristle brush portion. The second swab portion has a second outer diameter D2 that is greater than the inner diameter of the firearm barrel to be cleaned.

In another aspect of the invention, a firearm barrel cleaning tool is provided that includes a cleaning rod having a first end and an opposing second end. Further include is a barrel cleaning brush having a body defining a first end and an opposing second end, the first end secured to the second end of the cleaning rod. The firearm barrel cleaning tool further includes a pull-through handle secured to the first end of the cleaning rod. The pull-through handle includes a base, a swivel, and a handle portion attached to the base by the swivel. The handle portion has a closed position adapted for passage through the firearm barrel, and an open position adapted for pulling the cleaning rod and barrel cleaning brush through the firearm barrel.

BRIEF DESCRIPTION OF THE DRAWINGS

The features described herein can be better understood with reference to the drawings described below. The drawings are not necessarily to scale, emphasis instead generally being placed upon illustrating the principles of the invention. In the drawings, like numerals are used to indicate like parts throughout the various views.

DETAILED DESCRIPTION OF THE INVENTION

Figure 1:
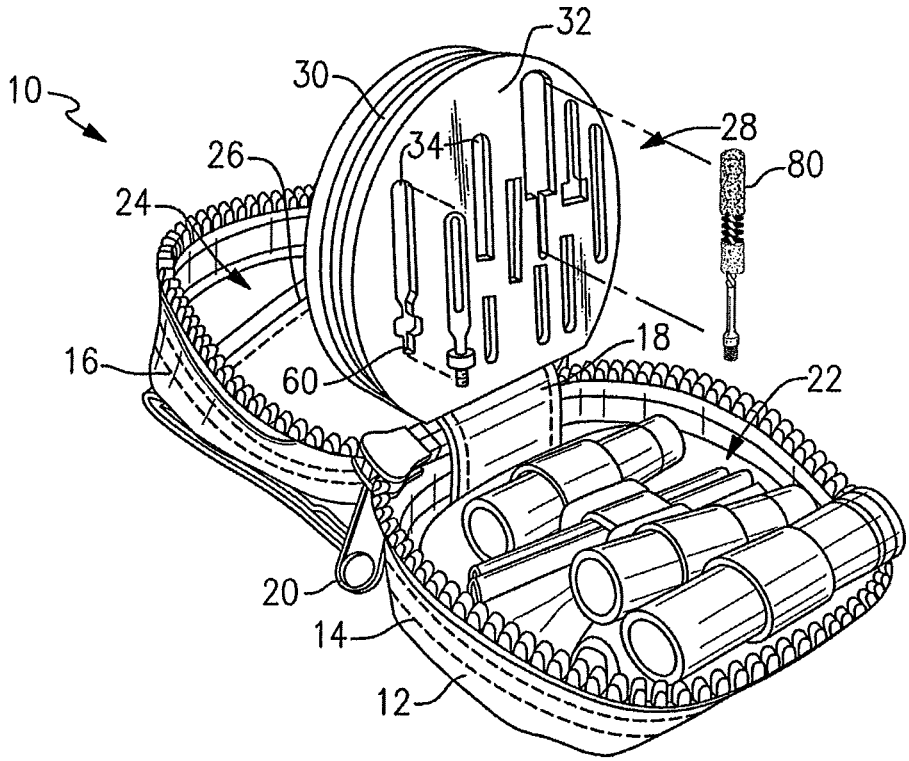
FIG. 1 shows a perspective view of an interior of a firearm cleaning kit according to an embodiment of the invention.

Referring to FIG. 1 of the drawings, an interior view of a firearm cleaning kit 10 is shown. A case 12 includes a first compartment 14 and a second compartment 16 separated by a fold line 18. The fold line 18 joins the first compartment 14 to the second compartment 16, allowing the two to be folded up in a clamshell-type arrangement. In the embodiment shown, the case 12 is generally circular in shape, but any shape that permits the first compartment 14 and the second compartment 16 to be folded together in clamshell fashion is suitable. For example, the case 12 could be square or rectangular in shape, with one side serving as the fold line 18. The case 12 may be made from a soft, durable fabric, or may be a rigid, hard shell construction if increased toughness is required. In the embodiment shown, the case 12 is constructed of nylon fabric to allow some compression.

The kit 10 further includes a fastener 20 to secure the first compartment 14 to the second compartment 16 when the case 12 is in the closed position. The fastener 20 in the disclosed embodiment is a zipper, configured to zip along three sides of the case 12. Other fastener configurations are possible. For example, the fastener 20 may be one or more snaps, flexible strips such as VELCRO® brand fasteners, or ties. The fastener 20 in the preferred embodiment is a silent zipper due to its strength, ease of use, and quiet operation.

The case 12 includes a first interior region 22 defined by the first compartment 14, and a second interior region 24 defined by the second compartment 16. A pocket 26 sewn into the first interior region 22 and/or the second interior region 24 of case 12 holds cleaning materials such as a flexible cleaning rod and bore patches (not shown).

The kit 10 further includes a tool compartment 28 secured to the fold line 18 of the case 12. In the disclosed embodiment, the tool compartment 28 comprises a backing 30 and at least one tool insert 32. The backing 30 may be made of a thin, rigid plastic. The tool insert 32 is secured to the backing 30, and is preferably composed of foamed rubber. The tool insert 32 contains a plurality of tool-holding cavities 34 to hold respective cleaning tools therein. In the example configuration shown, the tool-holding cavities 34 may contain a cleaning tip 60 and a barrel cleaning brush 80, features and aspects of which will be explained in detail below. Other examples of cleaning tools held in the tool-holding cavities 34 include slotted tips, picks, adapters, handles, obstruction removers, mats, scrapers, and a bore reflector (all not shown). The tool compartment 28 may also be secured to the first interior region 22 and/or the second interior region 24 of the case 12.

Figure 2:
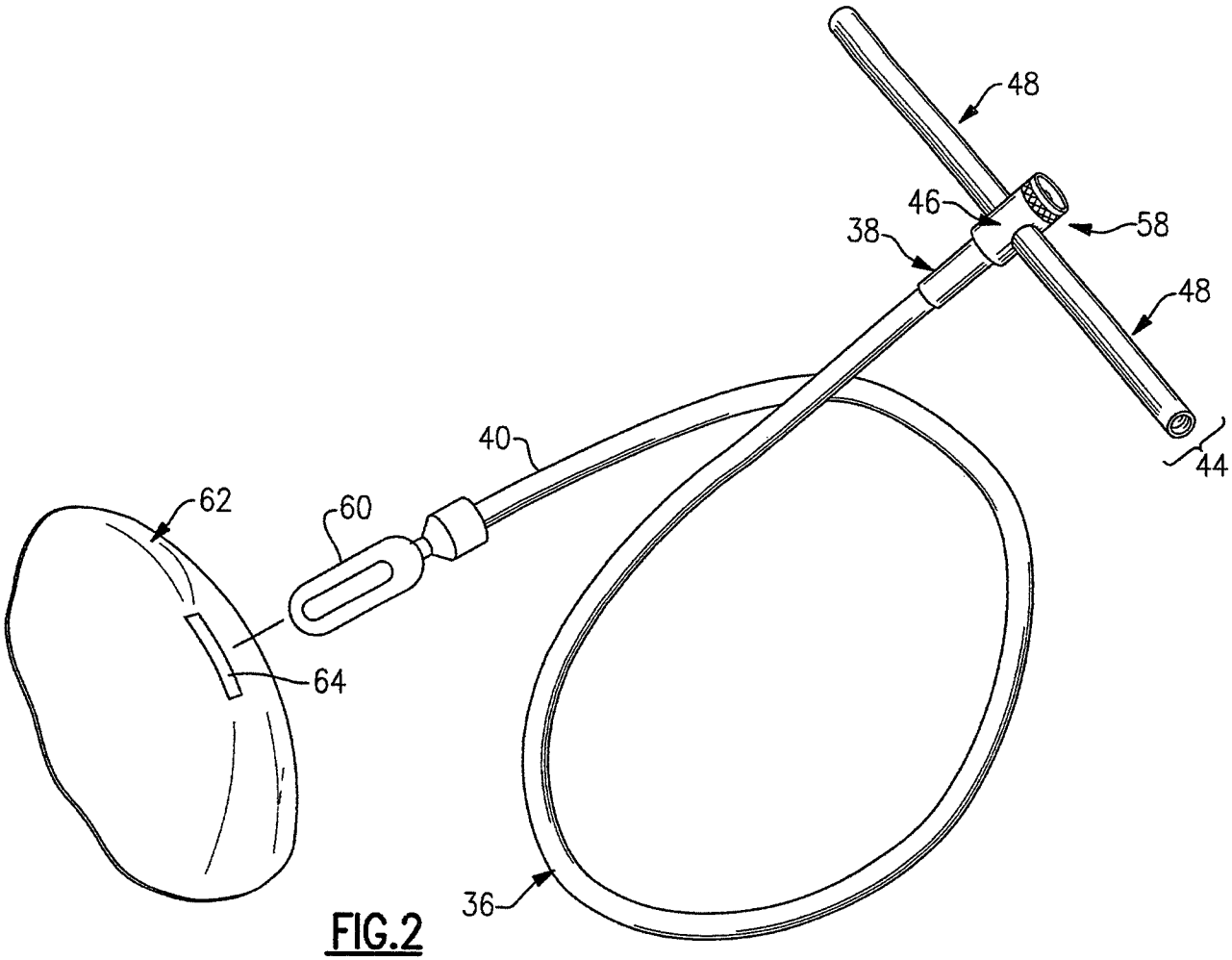
FIG. 2 shows a perspective view of a cleaning attachment for the cleaning kit shown in FIG. 1.

Referring to FIG. 2, an example configuration of the firearm cleaning kit 10 is shown. A cleaning rod 36 having a first end 38 and a second end 40 serves as the common base for many of the cleaning attachments. The first end 38 and the second end 40 of the cleaning rod 36 may have a connection element 42 (hidden, but shown in FIG. 9) such as a threaded member. In this manner, the various cleaning attachments may be quickly and securely attached and removed from the cleaning rod 36. In the example shown, the cleaning rod 36 is flexible. In a preferred example, the cleaning rod 36 is a multi-strand braided wire with plastic coating. The plastic-coated wire may be conveniently coiled and stored in the pocket 26 when not in use.

Figure 3:
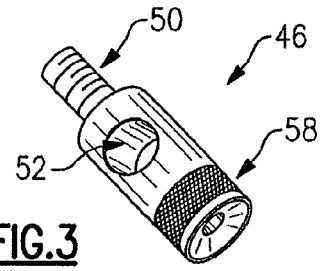
FIG. 3 shows a perspective view of the end adapter of FIG. 2.
Figure 4:
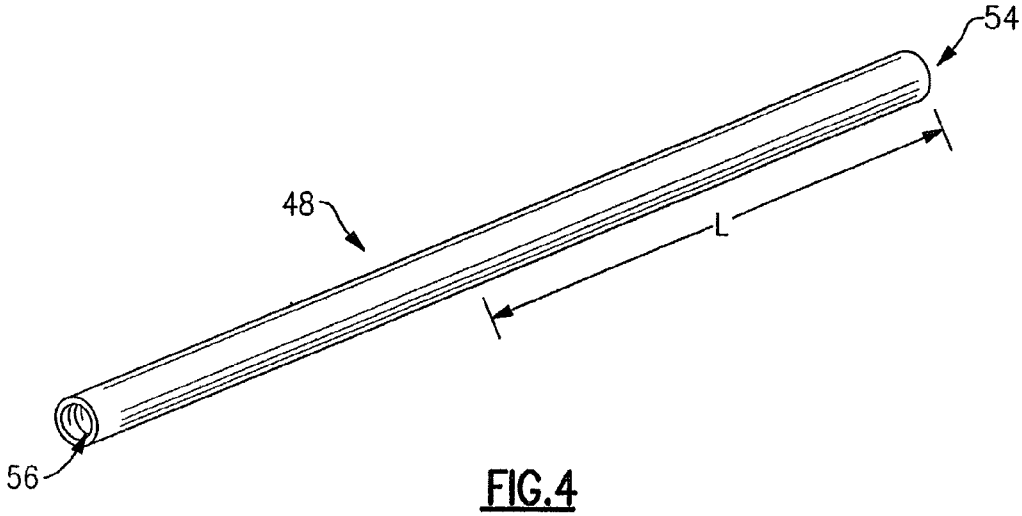
FIG. 4 shows a perspective view of the tee handle bar of FIG. 2.

The first end 38 of the cleaning rod 36 may include a tee handle 44. The tee handle 44 may be of unitary construction or, as shown, may be comprised of an end adapter 46 and a bar 48. In another embodiment, shown in FIGS. 7 and 8 and described hereinbelow, the tee handle 1044 may be foldable so as to readily fit through the bore of the weapon being cleaned. As shown in FIGS. 3 and 4, the end adapter 46 includes a threaded portion 50 to removably couple to the first end 38 of the cleaning rod 36. The end adapter 46 defines a thru bore 52 into which the bar 48 is slideably disposed. A first end 54 of the bar 48 may be slightly larger than the diameter of the bore 52. The larger diameter may extend for a length "L", as shown in FIG. 4, and taper to the nominal diameter of the bar 48. In this manner, a second end 56 of the bar 48 may slide through the bore 52 in the end adapter 46, but will only slide up to the larger diameter, thus positioning the bar 48 at its mid-section. When the tee handle 44 is assembled to the first end 38 of the cleaning rod 36, a handle is formed. A knurl 58 may be formed on the tee handle 44 to aid in threading the tee handle to the cleaning rod 36.

Referring now back to FIG. 2, one example attachment to cleaning rod 36 is a cleaning tip 60, which may also threadably couple to the second end 40 of the cleaning rod. The cleaning tip 60 secures a cleaning patch 62. The cleaning patch 62 includes at least one slit 64 through which the cleaning tip 60 is placed in order to secure the patch for cleaning.

Figure 5:
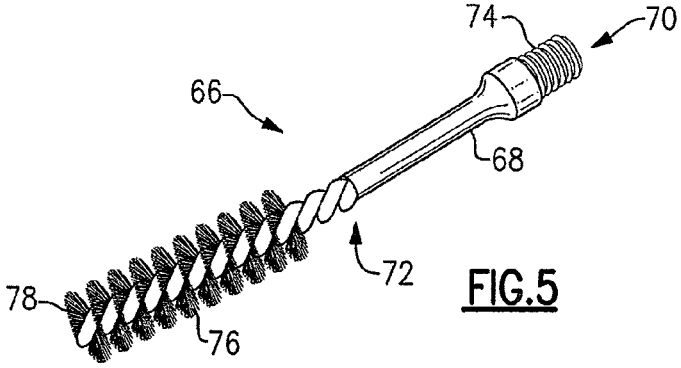
FIG. 5 shows a perspective view of a bore brush for use with the cleaning kit shown in FIG. 1.

Referring to FIG. 5, another attachment for the cleaning rod 36 is a bore brush 66. The bore brush 66 includes a core 68 defining a first end 70 and a second end 72. In the example shown, the core 68 is comprised of brass and includes a threaded member 74 on the first end 70 to threadably couple to the second end 40 of the cleaning rod 36 (FIG. 2). The core 68 further includes a hollowed-out or tubular segment on the second end 72 into which a brush portion 76 is inserted. Once inserted, the second end 72 may be cold-welded or otherwise formed to secure the brush portion 76 in place. The brush portion 76 includes wire-wound strands of brass securing a plurality of bristles 78. The bristles 78 are preferably brass to aid in scraping residue from the barrel of a firearm.

To clean a firearm barrel with the cleaning apparatus described above, the cleaning patch 62 and the bore brush 66 are alternately moved through the barrel of the firearm. In one example, the cleaning patch 62 is first attached to the second end 40 of the cleaning rod 36. The first end 38 of the cleaning rod 36 is pushed through the barrel from breech to muzzle, then pulled through to drag the cleaning patch 62 through the bore to pick up dirt and abrasive particles. A solvent may be applied to the patch 62 to lubricate the bore and prevent sand or dirt from scratching the muzzle end of the barrel.

Next, the bore brush 66 is threadably coupled to the cleaning rod 36 and pulled through the bore in the same manner. The bore brush 66 serves to scrape the chamber of the firearm and loosen any residue adhered to the barrel. Any residue loosened by the bore brush 66 must be removed by the cleaning patch 62 prior to running the bore brush through the barrel again. If this important step is omitted, residue will be entrained in the bristles 78 of the bore brush 66 and be deposited in the chamber or bore the next time the brush is run through. The stiff bristles 78 will drag the residue through the bore, marring and scratching it.

As may be evident from the foregoing description, repeatedly exchanging the cleaning patch 62 and the bore brush 66 may become tedious and consumes time. In some situations, such as military environments, the firearm owner may chose to skip at least some of the exchanging steps if they are in a time-critical environment. This could lead to degradation or even malfunctioning of the firearm. The inventor has devised a barrel cleaning brush 80 that alleviates the foregoing problems without sacrificing the thoroughness of the cleaning.

Figure 6:
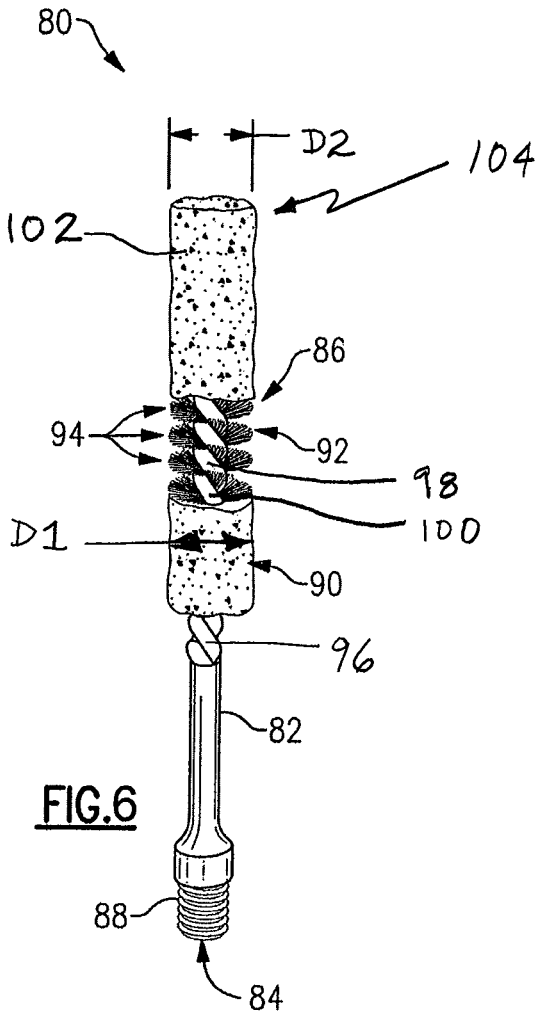
FIG. 6 shows a barrel cleaning brush according to an embodiment of the invention.
Figure 7:
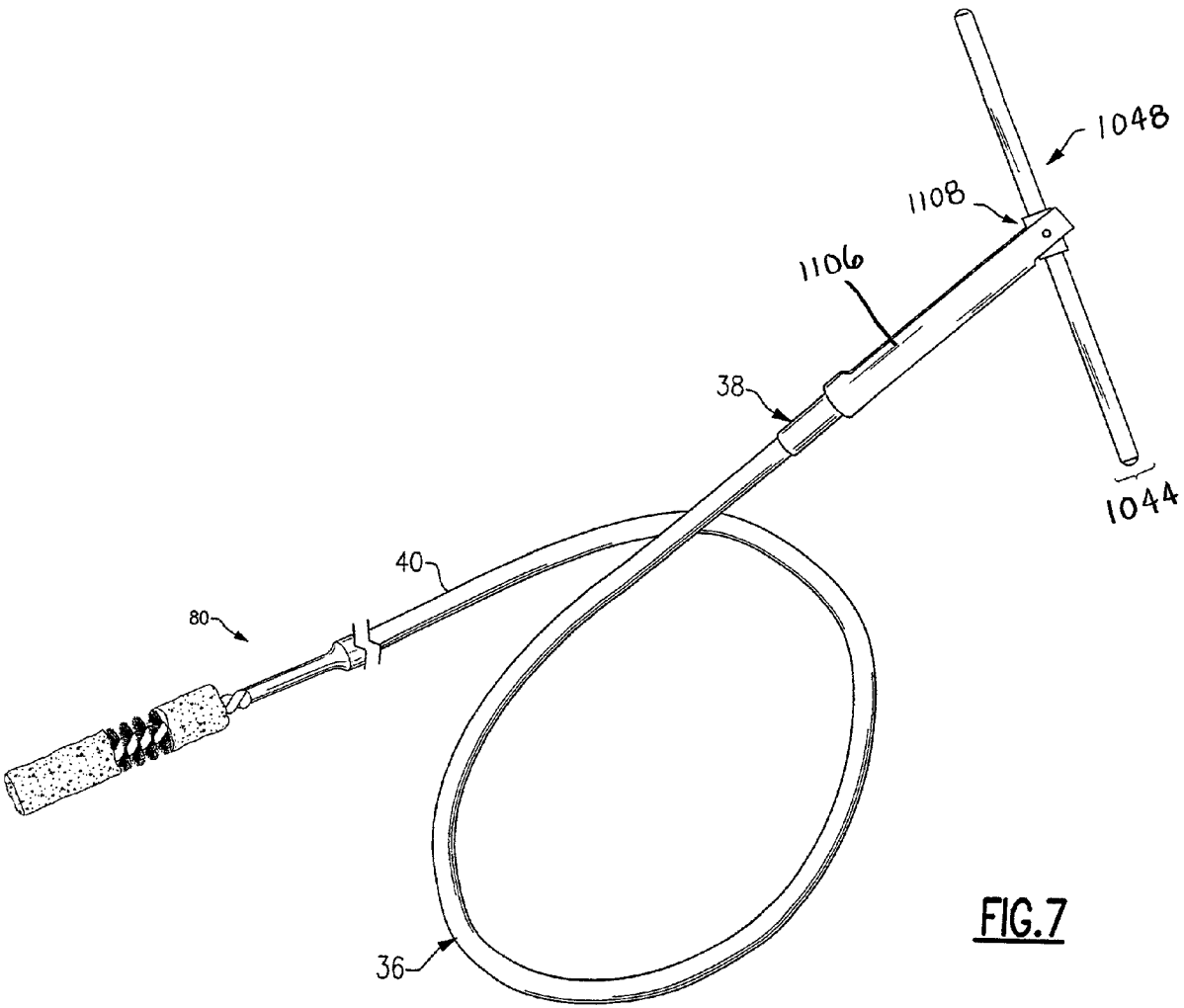
FIG. 7 shows a perspective view of a cleaning tool using the barrel cleaning brush of FIG. 6.

Referring now to FIG. 6 of the drawings, the firearm barrel cleaning brush 80 is shown in detail. The barrel cleaning brush 80 includes a body 82 defining a first end 84 and a second end 86. The first end 84 of the body 82 may be adapted with a connector portion 88 to removably couple the first end 84 of the body 82 to the first end 38 of the cleaning rod 36 (FIG. 7). In the disclosed example, the body portion 82 and the connector portion 88 are formed of brass, but may be formed of any suitable material according to the particular purpose for which they are intended to be used. The connector portion 88 is a male thread adapted to mate with a female thread on the first end 38 of the cleaning rod 36.

The barrel cleaning brush 80 further includes a first swab portion 90 affixed to the body 82. The first swab portion 90 is made of a soft, non-abrasive material that is also absorbent. The first swab portion 90 has an outer diameter "D1" that is greater than the inner diameter of the firearm barrel for which the barrel cleaning brush 80 is intended. In this manner, the first swab portion 90 will readily absorb a solvent, and fully contact the entire inner diameter of the barrel while being passed therethrough. In one embodiment, the first swab portion 90 may be positioned approximately mid-span on the body 82 of the barrel cleaning brush 80. In another embodiment, the first swab portion 90 may be positioned proximate to the second end 86 of body 82. By proximate, what is meant is that the first swab portion 90 is positioned on the body 82 closer to the second end 86 than the first end 84.

The barrel cleaning brush 80 further includes a bristle brush portion 92 affixed to the body portion 82, positioned proximate to the first swab portion 90 and in closer relation to the second end 86 of the body 82 than the first swab portion 90. In one embodiment, the bristle brush portion 92 is adjacent to the first swab portion 90. The bristle brush portion 92 has a plurality of filaments 94 arranged and sized to a diameter greater than the inner diameter of the firearm barrel and less than the diameter "D1" of the first swab portion 90. In the disclosed embodiment, the filaments 94 are formed of brass. The brass filaments 94 are stiff to provide superior scraping action, but soft enough to prevent scratching the inner bore of the firearm.

The body portion 82 of the barrel cleaning brush 80 may include a wire-wound stem portion 96 to reliably secure the filaments 94. The wire-wound stem portion 96 may include a first wire 98 and a second wire 100 in intertwining relationship, twisted and bent over at the second end of the body to prevent sharp edges. In a preferred example, the intertwined first and second wires 98, 100 are formed from a single wire strand, doubled over to form a loop prior to the twisting operation. In this manner, no sharp edges are present at the second end 86 of the body 82. One end of the filaments 94 may be interspersed within the first and second wires 98, 100 of the stem portion 96 prior to the wire being spiral-wound. After winding, the end of the filaments 94 are squeezed between the spiraled first and second wires 98, 100 and thus securely fastened. Securing the filaments 94 to the body 82 in this manner assures a great deal of scraping force may be applied to the cleaning brush 80 without the filaments becoming loose and lodging in the gun barrel. After spiral forming, the wire-wound stem 96 may be secured to the first end 84 of the body portion 82 by cold welding, for example.

The barrel cleaning brush 80 further includes a second swab portion 102 affixed to the body 82 and extending radially therefrom. The second swab portion 102 is proximate to the bristle brush portion 92 and is positioned closer to the second end 86 of the body 82 than the bristle brush portion 92. In one embodiment, the second swab portion 102 is positioned at a tip 104 or outermost extremity of the second end 86. Similar to the first swab portion 90, the second swab portion 102 is made of a soft, non-abrasive material that is also absorbent. The second swab portion 102 has an outer diameter "D2" that is greater than the inner diameter of the firearm barrel for which the barrel cleaning brush 80 is intended. In this manner, the second swab portion 102 can readily absorb a solvent or lubricant, and will fully contact the entire inner diameter of the barrel while being passed therethrough.

The disclosed barrel cleaning brush 80 thus provides a compact cleaning tool capable of performing several cleaning steps in one pass through the gun barrel. In one example, which is not intended to be limiting, the cleaning brush 80 is attached to the second end 40 of a flexible cleaning rod, such as the rod 36 illustrated in FIG. 7. The first end 38 of the flexible cleaning rod 36 is pushed down the barrel from breech to muzzle in the direction of the bullet or shot. A pull-through tee handle 1044 may be secured to the first end 38 of the rod to facilitate the pull-through cleaning process. Instead of performing a separate cleaning step using the cleaning tip 60 and cleaning patch 62 described above (FIG. 2), a quick field cleaning can be performed using the barrel cleaning brush 80 of the current invention by threadably coupling the cleaning brush to the second end 40 of the flexible cleaning rod 36.

Solvent is first applied to the first swab portion 90, and optionally the second swab portion 102, to remove carbon, gun powder, dirt, and grime from metal surfaces. One exemplary solvent is Otis O85® Ultra Bore® solvent from Otis Technologies, Lyons Falls, N.Y., which is an all-in-one cleaner, lubricant, and preservative. As the barrel cleaning brush 80 is pulled through the firearm barrel (aided by the pull-through tee handle 1044), the first swab portion 90 contacts the barrel, applying the solvent. The bristle brush portion 92 then scrapes the residue from the barrel surfaces. The residue and debris is then captured or mopped up by the second swab portion 102, which is proximate to the brush portion 92. Note that 360° coverage of the firearm barrel is provided by the swabs and brush.

As used herein, "proximate" means the bristle brush portion 92 and second swab portion 102 are spaced close enough to reliably work in tandem while disposed on the same tool. The bristle brush portion 92 and second swab portion 102 work in tandem because much of the residue scraped from the inner bore of the firearm does not re-deposit itself onto the inner wall of the barrel; it is quickly absorbed onto the second swab portion 102. In a preferred example, the bristle brush portion 92 is positioned adjacent the second swab portion 102. In this manner, as the stiff filaments 94 scrape off the residue from the inner bore of the firearm, the filaments 94 will tend to "flick" the residue particles rearward (e.g., opposite to the motion of cleaning rod 36) directly onto the second swab portion 102. The amount of residue re-deposited on the inner bore of the firearm during the cleaning process is thus minimized. The diameter of the bristle brush portion 92 is sized less than the diameter D2 of the second swab portion 102 to assure ease of movement through the bore on the part of the brush while simultaneously assuring the swab is adequately compressed to contact the entire bore and capture all the residue created by the brush. In another example wherein the solvent does not include a lubricant, the solvent may be applied to the first swab portion 90 and lubricant may be applied to the second swab portion 102.

As may be appreciated with respect to the illustrative cleaning procedure thus described, the capability to provide several cleaning steps in one pass through the barrel of the firearm presents options for the choice of material and configuration. The options may be selected depending upon the particular firearm or gage being cleaned.

In one embodiment, at least one of the first swab portion 90 and the second swab portion 102 are formed of a plurality of twisted fiber strands that are secured in the wire-wound stem portion 96. The twisted fiber strands form a nap having a nap height that is greater than half the inner diameter of the firearm barrel. This nap height similarly assures the first swab portion 90 or the second swab portion 102 is adequately compressed to contact the entire inside bore of the firearm barrel and capture the residue created by the bristle brush portion 92. In one example, the twisted fibers form singular frayed strands, thereby providing superior absorbency. In another example, the twisted fiber strands are doubled over to form a loop, similar to carpet pile. The strand loops are more durable because they better withstand the rigors of the cleaning process.

In one example, both the first swab portion 90 and the second swab portion 102 are formed of twisted fiber strands secured to the wire-wound stem portion 96. The strands may be squeezed between the first and second wires 98, 100, in a like manner to the filaments 94 described above. The twisted fiber strands may be formed of a cotton material, for example. The twisted fiber strands may be tightly packed or loosely spaced on the body, thereby defining a fiber strand density. The fiber strand density may vary depending upon the particular function of the swab. For example, as noted above, the first swab portion 90 may provide a solvent applicator function, and the second swab portion 102 may provide a cleaning and/or mopping function. The fiber strand density of the first swab portion 90 may therefore be greater than the fiber strand density of the second swab portion 102. Additionally or alternatively, the outer diameter D2 of the second swab portion 102 may be greater than the outer diameter D1 of the first swab portion 90 because the second swab portion may require more friction force to remove the debris and particles, while the first swab portion may only require the application of a thin layer of solvent.

In another embodiment, either the first swab portion 90 or the second swab portion 102 is formed of twisted fiber strands, and the other swab portion is formed of a felt material. In one example, the first swab portion 90 may be formed of felt to provide superior absorbency for the cleaning solvent, and the second swab portion 102 may be formed of cotton twisted fiber strands to provide superior mopping action of the residue and debris. In yet another embodiment, either the first swab portion 90 or the second swab portion 102 are formed of twisted fiber strands, and the other swab portion is formed of a foam material.

As noted above, the disclosed barrel cleaning brush 80 provides a compact cleaning tool capable of performing several cleaning steps in one pass through the gun barrel. In one embodiment, the total length of the cleaning brush 80 is less than 3 inches in length, which allows the cleaning brush 80 to be readily stored in a compact firearm cleaning kit case (see FIG. 1, for example). In one example, the total length of the cleaning brush 80 is 2.30 inches (5.8 cm). The second swab portion 102, which is positioned at the tip 104, can have a mean diameter of 0.424 inches (1.077 cm) and an axial length of 0.80 inches (2.0 cm). The bristle brush portion 92, which is positioned adjacent to the second swab portion 102, can have an axial length of 0.50 inches (1.27 cm) and the filaments 94 can be formed at a diameter of 0.264 inches (0.671 cm). The first swab portion 90, which is positioned adjacent to the bristle brush portion 92, can have an axial length of 0.25 inches (0.635 cm) and can also have a mean diameter of 0.424 inches (1.077 cm). The remaining portion of the body 82 is thus 0.75 inches (1.91 cm), which leaves adequate length for the formation of the threaded connector portion 88. In this embodiment, the body portion 82, connector portion 88, and wire-wound stem portion 96 are preferably formed of brass for durability and corrosion protection.

Figure 8:
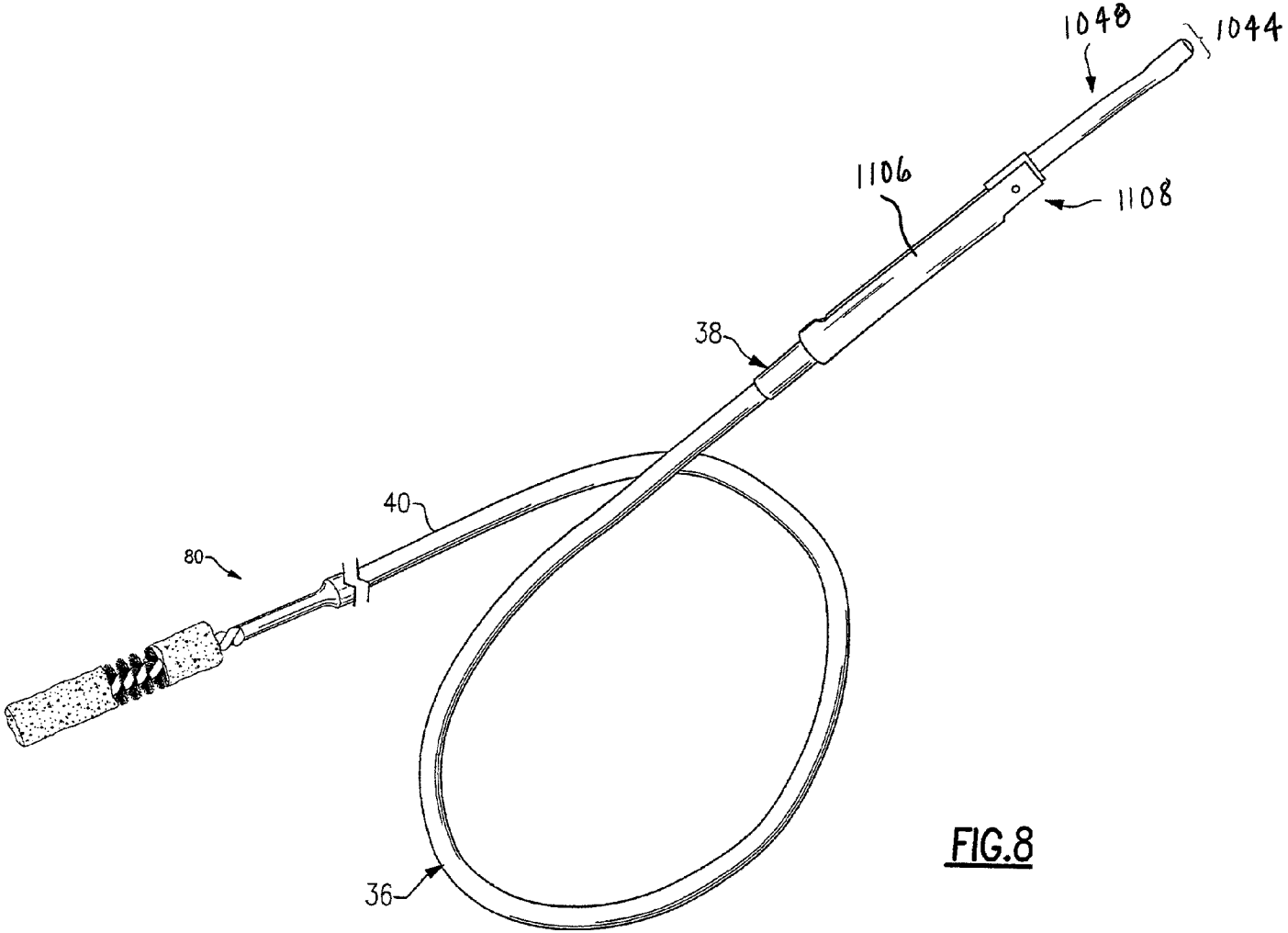
FIG. 8 shows another perspective view of the cleaning tool of FIG. 7.

Referring to FIGS. 7 and 8 of the drawings, wherein like numerals are used to indicate like parts from FIG. 2, a perspective view of the aforementioned pull-through handle 1044 is depicted in an open position and a closed position, respectively. Pull-through handle 1044 has dimensions such that, in the closed position, as shown in FIG. 8, pull-through handle 1044 may fit through the bore of a firearm, such as an M4 carbine, in an illustrative embodiment. Some firearms such as those chambered for 0.223 (5.56 mm) have a small bore that renders it difficult to design a conventional folding tee handle (such as tee handle 44 in FIG. 2) that could pass through the bore. Consequently, current methods for small bores would require either attaching a handle after passing the rod or cable through the bore, or not using a tee handle. Other embodiments may be sized to fit through the bore of any of a wide variety of types and calibers of firearms. Pull-through handle 1044 has a base 1106, a threaded attachment portion 1050 (not shown, but similar to threaded portion 50 in FIG. 3) at the end of base 1106, a swivel 1108, and a handle portion 1048 attached to base 1106 by swivel 1108. Any of a wide variety of cleaning tools or other attachments may be attached to pull-through handle 1044 by being screwed onto threaded attachment portion 1050.

Because of its dimensions, when pull-through handle 1044 is in the closed position as in FIG. 8, pull-through handle 1044 may be dropped into a firearm bore from the breech end and dropped toward the muzzle, with any attachment following it through the bore. Once pull-through handle 1044 emerges from the muzzle, a user may unfold the handle portion 1048 into the open position. This enables the user to pull on the pull-through handle with significant force. For example, the flexible cable 36 may be attached to threaded attachment portion 1050 with a cleaning implement, such as barrel cleaning brush 80, attached on the other end of the flexible cable. The cleaning implement may exert significant frictional forces against the interior of the bore, such that it may be advantageous to the cleaning process to be able to draw the cleaning implement through the bore with significant force, which is made possible with pull-through handle 1044.

Pull-through handle 1044 also has the advantage of being attached to the flexible cable 36 and cleaning implement 80 throughout the process of pulling the combined assemblage of pull-through handle, cable, and cleaning implement through the barrel, so that the combined assemblage can be stored together in a completely attached state beforehand, remain in a completely attached state during the cleaning process, and be stowed again still in the completely attached state once the user is finished performing the cleaning process. This provides a significant advantage over some other systems in which a cable is dropped through a bore and then a lone handle attachment (e.g., FIG. 2) is attached to the cable only after the cable emerges through the muzzle or no handle is used at all, which diminishes the effective pulling force capability. Pull-through handle 1044, by being able to be stored, used, and stowed again while remaining attached to the rest of the assemblage throughout the process, eliminates the need for the user to manipulate a lone handle portion and to have to go through the process of attaching a lone handle portion to a cable during the middle of the cleaning process. A lone handle portion on its own is relatively small, and the process of attaching it to a cable in the middle of a cleaning process may require some degree of concentration and care, which may be difficult in a field operations setting. Pull-through handle 1044, by being able to be stored, used, and stowed again while remaining attached to the rest of the assemblage throughout the process, may make the cleaning process as easy and simple as possible, which may make the difference for a successful cleaning process in a field operations setting.

Figure 9:
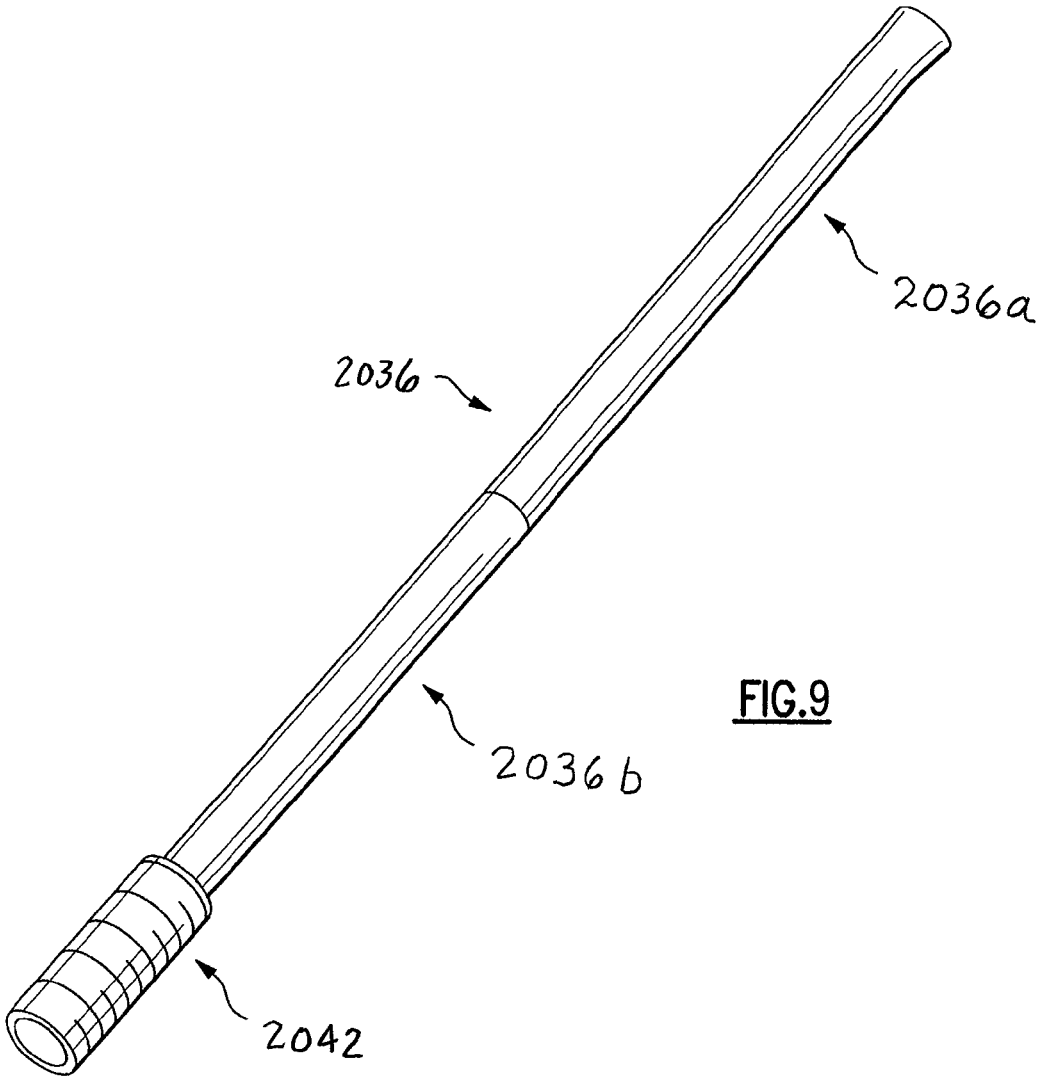
FIG. 9 shows a perspective view of an alternate cleaning rod for use with the barrel cleaning brush of FIG. 6.

Referring now to FIG. 9 of the drawings, wherein like numerals indicate like elements from FIG. 2, an alternate embodiment of the cleaning rod is shown. In this embodiment, the cleaning rod 2036 is rigid and includes a plurality of cleaning rod segments 2036*a*, 2036*b* that may be coupled together, for example by threading together. The rigid cleaning rod 2036 may be assembled at connection element 2042 and inserted down the bore at the muzzle end, and the barrel cleaning brush 80 may be attached to the cleaning rod from the breech end. The cleaning procedure would then proceed as described above.

While the present invention has been described with reference to a particular preferred embodiment and the accompanying drawings, it will be understood by those skilled in the art that the invention is not limited to the preferred embodiment and that various modifications and the like could be made thereto without departing from the scope of the invention as defined in the following claims.

What is claimed is:

1. A firearm barrel cleaning brush, comprising:

a body defining a first end and an opposing second end, the first end having a connector portion;

a first swab portion affixed to the body, the first swab portion extending radially from the body and having a first outer diameter D1 greater than an inner diameter of the firearm barrel to be cleaned;

a bristle brush portion affixed to the body proximate to the first swab portion and positioned closer to the second end of the body than the first swab portion; and a second swab portion affixed to the body and extending radially therefrom, the second swab portion proximate the bristle brush portion and positioned closer to the second end of the body than the bristle brush portion, the second swab portion having a second outer diameter D2 greater than the inner diameter of the firearm barrel to be cleaned;

wherein one of the first swab portion and the second swab portion are formed of twisted fiber strands secured to the body;

wherein the body comprises a wire-wound stem portion formed of a first wire and a second wire in intertwining relationship, the fiber strands secured between the first wire and second wire.

2. The firearm barrel cleaning brush according to claim 1, wherein the body is rigid.

3. The firearm barrel cleaning brush according to claim 1, wherein both of the first swab portion and the second swab portion are formed of twisted fiber strands secured to the body.

4. The firearm barrel cleaning brush according to claim 3, wherein a first fiber strand density of the first swab portion is greater than a second fiber strand density of the second swab portion.

5. The firearm barrel cleaning brush according to claim 1, wherein the twisted fiber strands are formed of cotton material.

6. The firearm barrel cleaning brush according to claim 1, wherein the other of the first swab portion and the second swab portion is formed of a felt material.

7. The firearm barrel cleaning brush according to claim 6, wherein the first swab portion is formed of a felt material and the second swab portion is formed of twisted fiber strands.

8. The firearm barrel cleaning brush according to claim 1, wherein at least some of the twisted fiber strands are doubled over to form a loop having two strand ends, the strand ends secured to the body.

9. The firearm barrel cleaning brush according to claim 1, wherein the first wire and the second wire are formed from a single wire strand, doubled over to form a loop.

10. The firearm barrel cleaning brush according to claim 1, wherein the first swab portion, the bristle brush portion, and the second swab portion are intertwined between the first wire and the second wire.

11. The firearm barrel cleaning brush according to claim 1, wherein the outer diameter D1 of the first swab portion is less than the outer diameter D2 of the second swab portion.

12. The firearm barrel cleaning brush according to claim 1, wherein the connector portion comprises a threaded member.

13. The firearm barrel cleaning brush according to claim 1, wherein the body is less than 3 inches in length.

14. The firearm barrel cleaning brush according to claim 1, wherein the second swab portion is positioned at a tip of the second end of the body.

* * * * *